US005454414A

United States Patent [19]

Colson et al.

[11] Patent Number: 5,454,414

[45] Date of Patent: Oct. 3, 1995

[54] WINDOW BLIND MATERIAL AND WINDOW COVERING ASSEMBLY

[75] Inventors: Wendell B. Colson, Boulder; James M. Anthony, Denver; Brad H. Oberg, Littleton, all of Colo.; Cornelis M. Jansen, Woudrichem, Netherlands

[73] Assignee: Hunter Douglas Inc., Upper Saddle River, N.J.

[21] Appl. No.: 963,318

[22] Filed: Oct. 20, 1992

Related U.S. Application Data

[63] Continuation-in-part of Ser. No. 810,331, Dec. 19, 1991, Pat. No. 5,287,908.

[51] Int. Cl.[6] ..... E06B 3/94

[52] U.S. Cl. ..... 160/84.02; 160/168.1

[58] Field of Search ..... 160/84.1 D, 84.1 E, 160/121.1, 170, 171, 168.1 V

[56] References Cited

U.S. PATENT DOCUMENTS

| | | | |
|---|---|---|---|
| 286,027 | 10/1883 | Lobdell . | |
| 718,992 | 1/1903 | Emery . | |
| 1,958,695 | 5/1934 | Claus . | |
| 2,029,675 | 2/1936 | Schlamp . | |
| 2,140,049 | 12/1938 | Grauel . | |
| 2,620,850 | 12/1952 | Janowski . | |
| 2,688,356 | 9/1954 | Conti . | |
| 2,822,840 | 2/1958 | Reynolds . | |
| 2,834,412 | 5/1958 | Velke . | |
| 2,865,446 | 12/1958 | Cole . | |
| 3,141,497 | 7/1964 | Griesser | 160/170 |
| 3,371,702 | 3/1968 | Keegan et al. . | |
| 3,384,519 | 5/1968 | Froget . | |
| 3,421,276 | 1/1969 | LaBarge . | |
| 3,509,934 | 5/1970 | Smart . | |
| 3,661,665 | 5/1972 | Froget . | |
| 3,701,376 | 10/1972 | Froget . | |
| 3,708,009 | 1/1973 | Viol . | |
| 3,783,931 | 1/1974 | Assael . | |
| 4,019,554 | 4/1977 | Rasmussen | 160/120 X |
| 4,182,088 | 1/1980 | Ball . | |
| 4,202,395 | 5/1980 | Heck et al. . | |
| 4,344,474 | 8/1982 | Berman . | |
| 4,434,834 | 3/1984 | Ennes . | |
| 4,473,101 | 9/1984 | Langeler . | |
| 4,519,434 | 5/1985 | Forquer . | |
| 4,623,012 | 11/1986 | Rude et al. | 160/171 X |
| 4,647,488 | 3/1987 | Schnebly . | |
| 4,673,018 | 6/1987 | Judkins . | |
| 4,687,038 | 8/1987 | Clemente . | |
| 4,694,543 | 9/1987 | Conley . | |
| 4,732,630 | 3/1988 | Schnebly . | |

(List continued on next page.)

FOREIGN PATENT DOCUMENTS

| | | |
|---|---|---|
| 0220074 | 4/1987 | European Pat. Off. . |
| 319458 | 11/1902 | France . |
| 847779 | 10/1939 | France . |
| 1309194 | 10/1962 | France . |
| 1321456 | 2/1963 | France . |
| 1373515 | 8/1964 | France . |
| 122088 | 4/1900 | Germany . |
| 382758 | 5/1922 | Germany . |
| 1241361 | 5/1967 | Germany . |
| 8906284 | 9/1989 | Germany . |
| 6508988 | 1/1967 | Netherlands . |
| 7805464 | 10/1979 | Netherlands . |
| 951484 | 3/1964 | United Kingdom . |
| 1036126 | 7/1966 | United Kingdom . |
| 1116934 | 6/1968 | United Kingdom . |

*Primary Examiner*—David M. Purol
*Attorney, Agent, or Firm*—Gary M. Polumbus; Holland & Hart

[57] ABSTRACT

A window blind material and window blind assembly is formed by a front sheet and a rear sheet, both of translucent or transparent light transmitting material. A plurality of spaced, intermediate, parallel, preferably opaque or semi-opaque, vanes are secured between the sheets. The vanes can be positioned to control the transmission of light by movement of the sheets relative to one another. A tilt member connected to the sheets is rotated to position the sheets and vanes. A bottom rail is secured to the sheets.

18 Claims, 4 Drawing Sheets

U.S. PATENT DOCUMENTS 4,799,299 1/1989 Campbell .
4,862,941 9/1989 Colson .
4,885,190 12/1989 Schnebly .
4,912,900 4/1990 Yeamans .
4,955,421 9/1990 Torti ..... 160/170 X
5,002,628 3/1991 Schnebly .
5,070,924 12/1991 Bateman .

WINDOW BLIND MATERIAL AND WINDOW COVERING ASSEMBLY

CROSS REFERENCE TO RELATED APPLICATION

This application is a continuation-in-part of U.S. application Ser. No. 07/810,331, filed Dec. 19, 1991, now U.S. Pat. No. 5,287,908.

BACKGROUND TO THE INVENTION

The present invention relates to a window blind material and also to a window covering assembly which may employ such a material.

There are many known forms of window covering assembly including curtains, roller blinds, venetian blinds and the like. Recently there has been proposed a window covering assembly which includes first and second generally parallel spaced apart longitudinally extending sheer fabrics having a plurality of longitudinally spaced generally parallel transversely extending vanes fixedly secured to the first and second sheer fabrics to extend therebetween.

The sheer fabrics are often constructed of a translucent or transparent material and may be in the form of actual fabrics or non-woven fabrics or indeed may simply be sheets of plastics material. The vanes are usually opaque or semi-opaque and by adjusting the relative positions of the sheer fabrics, the vanes can be caused to tilt relative to one another rather in the manner of the slats of a venetian blind. Conventionally such assemblies have a bottom rail and the vanes extend horizontally, the sheer fabrics being supported on a tilt roll which can also be used as a wind up roll.

OBJECTS AND SUMMARY OF THE INVENTION

It is the principal object of the present invention to provide an improved window blind or window covering material which provides for improved light transmission control and is inexpensive yet provides an aesthetic appearance. Another object of the present invention is to provide a window covering formed of a material of the foregoing character which is readily mounted and controlled to provide the desired light transmission characteristics.

A further object of the present invention is to provide a window covering structure of the foregoing character which is easily and efficiently operated.

In accordance with the present invention, a window covering material is formed by spaced, parallel, pleated sheets and vanes disposed between them. The sheets are a front light transmitting sheet having a plurality of parallel alternately forwardly and rearwardly directed pleats formed therein, and a rear light transmitting sheet spaced apart from the front sheet in parallel relation and having a plurality of parallel alternately forwardly and rearwardly directed pleats formed therein. Each forwardly directed pleat on one of said sheets is in alignment with a rearwardly directed pleat on the other of said sheets. A plurality of spaced substantially parallel relatively non-light transmitting vanes are attached between the sheets. The vanes have opposite side edges, one side edge of each vane being attached to the front sheet and the other side edge being attached to the rear sheet. With the foregoing construction, when one of the sheets is moved with respect to the other in a relative direction of movement transverse to the vanes, the vanes are caused to lie perpendicular to said sheets to allow passage of light through the blind material. When the sheets are moved relative to each other in the opposite direction of movement, the vanes are caused at least partially to block the passage of light through the blind material.

Such a material may be mounted with the pleats extending either horizontally or vertically. For horizontal disposition, an elongated horizontal tilt member is provided which is rotatable about its longitudinal axis and is secured to the spaced sheets to move the sheets vertically relative to one another to position the intermediate vanes into light transmitting or light-blocking position. A headrail may be provided for supporting the tilt member, while a bottom rail may be secured to the lower ends of the sheets. Lift cords are provided extending between the bottom rail and the headrail and are either wound or pulled upwardly to lift the bottom rail to open the blind.

In order that the present invention will be fully understood, the following detailed description of preferred embodiments of the window blind material and assembly of the invention are given below, reference being made to the accompanying drawings.

DETAILED DESCRIPTION OF THE PREFERRED EMBODIMENTS

Figure 1:
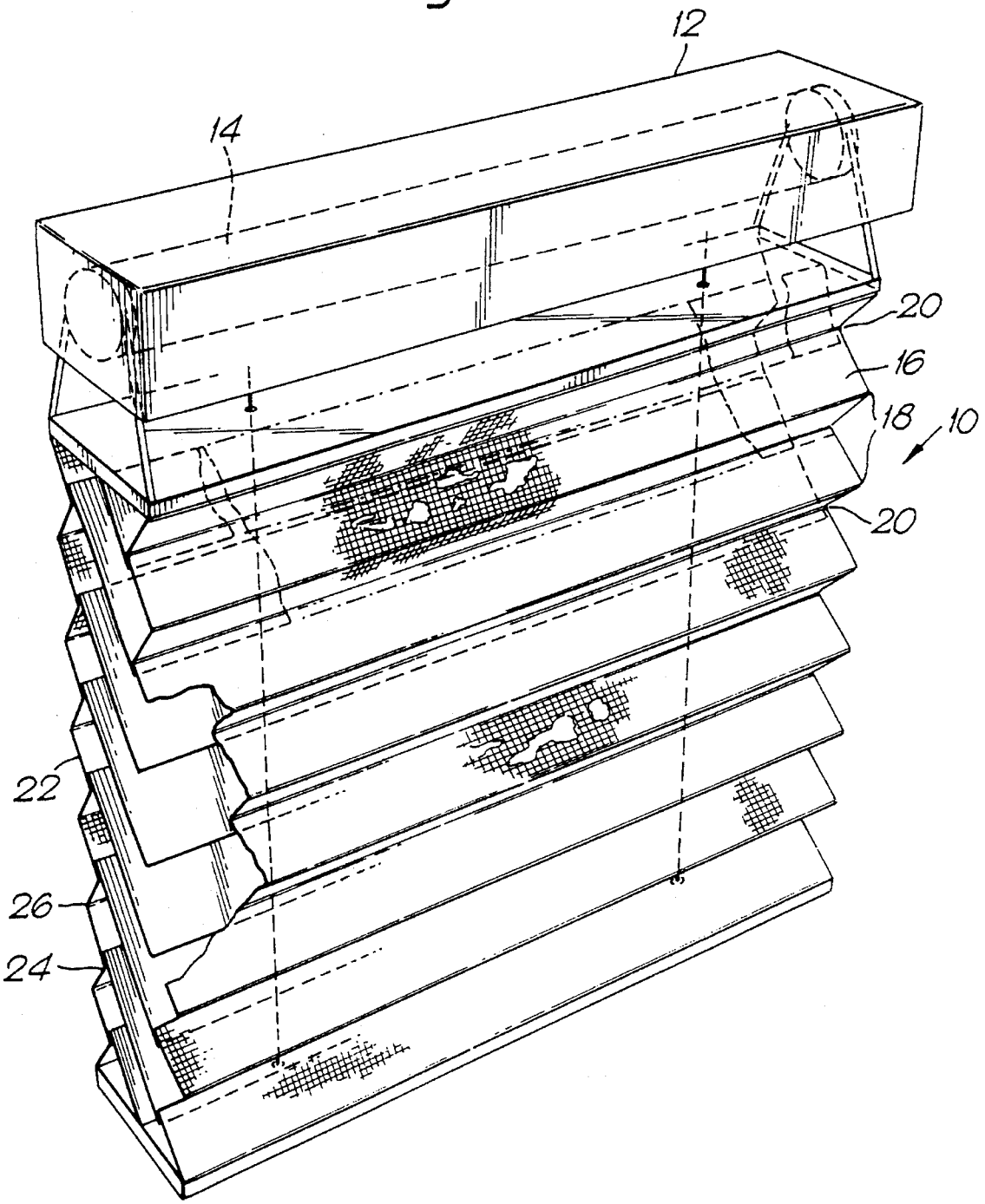
FIG. 1 is s a schematic perspective view of one embodiment of blind assembly according to the invention.

In FIG. 1 there is illustrated a first form of a window blind assembly indicated by the general reference numeral 10. This assembly in a neutral position 10 is associated with a headrail 12 provided with an elongate tilt roll member 14 (not shown) being provided to rotate this roll about its generally horizontal axis.

The assembly 10 includes a front light transmitting sheet on sheer fabric 16 provided with a plurality of spaced parallel, horizontal forward pleats 18 and rearward pleats 20. The assembly 10 also includes a rear light transmitting sheet or elongate sheer fabric 22 formed with forward pleats 24 and rearward pleats 26 similar to the pleats 18,20 of the front elongate sheer fabric 16.

Figure 2:
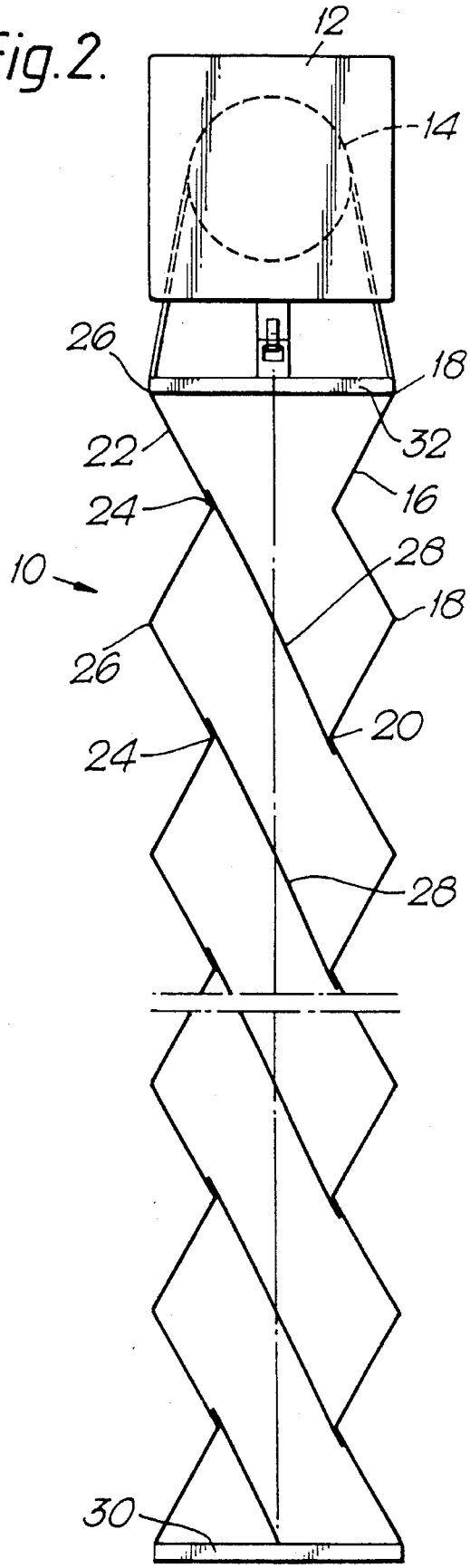
FIG. 2 is an end elevation of the blind assembly of FIG. 1.

As best seen in FIG. 2, in the neutral position of the assembly a plurality of vanes 28 interconnect the front and rear sheer fabrics 16,22. The vanes 28 in FIG. 2 extend between a rear, interior, face of a rearwardly extending pleat 20 of the front sheer fabric 16 diagonally upwardly to where it is connected to the forward interior face of a forwardly extending pleat 24 of the rear sheer fabric 22.

As shown the front and rear sheer fabrics 16,22 are connected to a bottom rail 30 adjacent their lower ends and are connected to the elongate tilt roll 14 at their upper ends. In the construction illustrated a spacer member 32 is provided below the headrail and is connected to the front and rear sheer fabrics adjacent further pleats 18,26 thereof. This spacer 32 is not essential but provides a better configuration for the upper parts of the pleated blind material.

Figure 3:
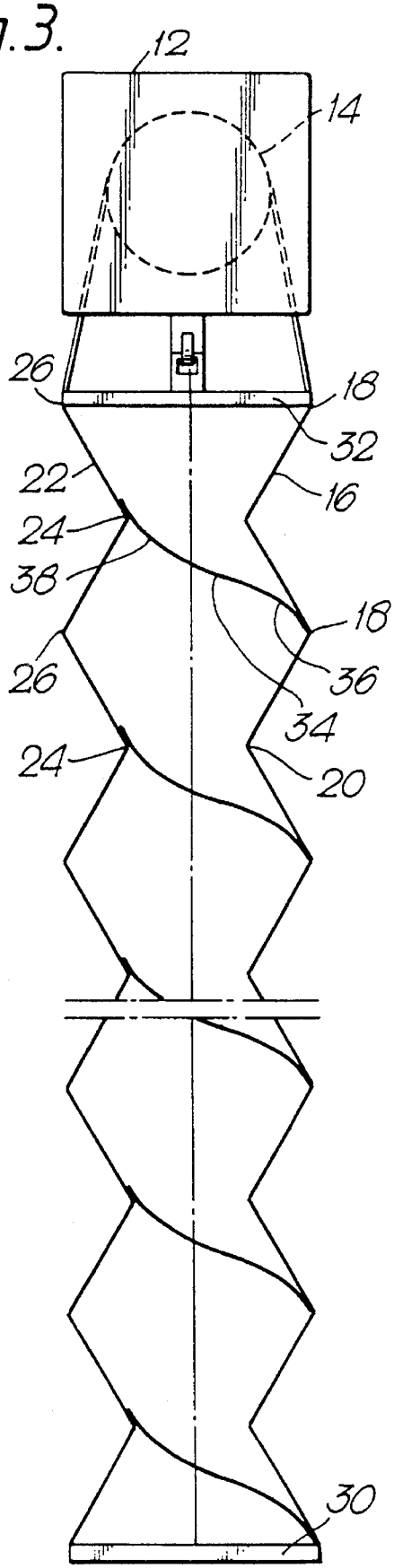
FIG. 3 is a view similar to FIG. 2 of a slightly modified version.

FIG. 3 shows a slightly modified structure in which like parts have been indicated by like reference numerals. The vanes are here indicated by the reference numeral 34 and are connected slightly differently. In this construction with the assembly in a neutral position, the lower parts of the vanes 34 are connected to the rear, interior, face of a forwardly extending pleat 18 of the front sheer fabric 16 and the vanes are again inclined diagonally upwardly and connected to the front, interior, face of a forwardly extending pleat 24 of the rear sheer fabric 22. In this construction the vanes 34 are not planar as in FIG. 1 but are reversed curved as shown at 36 and 38.

It will be appreciated that such a structure is, in some ways, rather similar to a venetian blind with the vanes 28,34. It will be appreciated that if the tilt roll 14, in either structure, is rotated in a clockwise sense, as seen in FIG. 2 or FIG. 3, the vanes 28,34, will overlie one another because they are in an overlapping mode and will thus, effectively, block the passage of light. If, however, the tilt roll 14 is tilted in a counter-clockwise sense, then the vanes 28,34, can be moved to a position in which they extend substantially horizontally, while remaining parallel to one another, so that there can be a passage of light therebetween.

For this purpose, therefore, the light transmitting sheets on sheer fabrics 16,22, need to be formed of a translucent or transparent material, such as paper, or woven fabric, or non-woven fabric, or indeed they can be made of a plastics material. Similarly, the vanes 28,34 can be made of any suitable material. However, they are preferably formed of an opaque or semi-opaque material to be relatively non-light transmitting when compared to said sheets 16,22.

The vanes are connected in a suitable manner to the respective pleats 18,20,24,26 as appropriate. While it is contemplated that this could be done by a heat technique, such as by welding, they are preferably adhered by means of a third material such as stitching or stapling, but according to a preferred arrangement they are connected by being adhered, preferably using a hot melt adhesive, which melts at a temperature significantly below the melt temperature of the sheer fabric. It would be appreciated that the sheer fabric needs to have the pleats set in it and this can be done by a heat setting process which should again be conducted at a temperature in excess of the temperature of melting of the hot melt adhesive.

Figure 4:
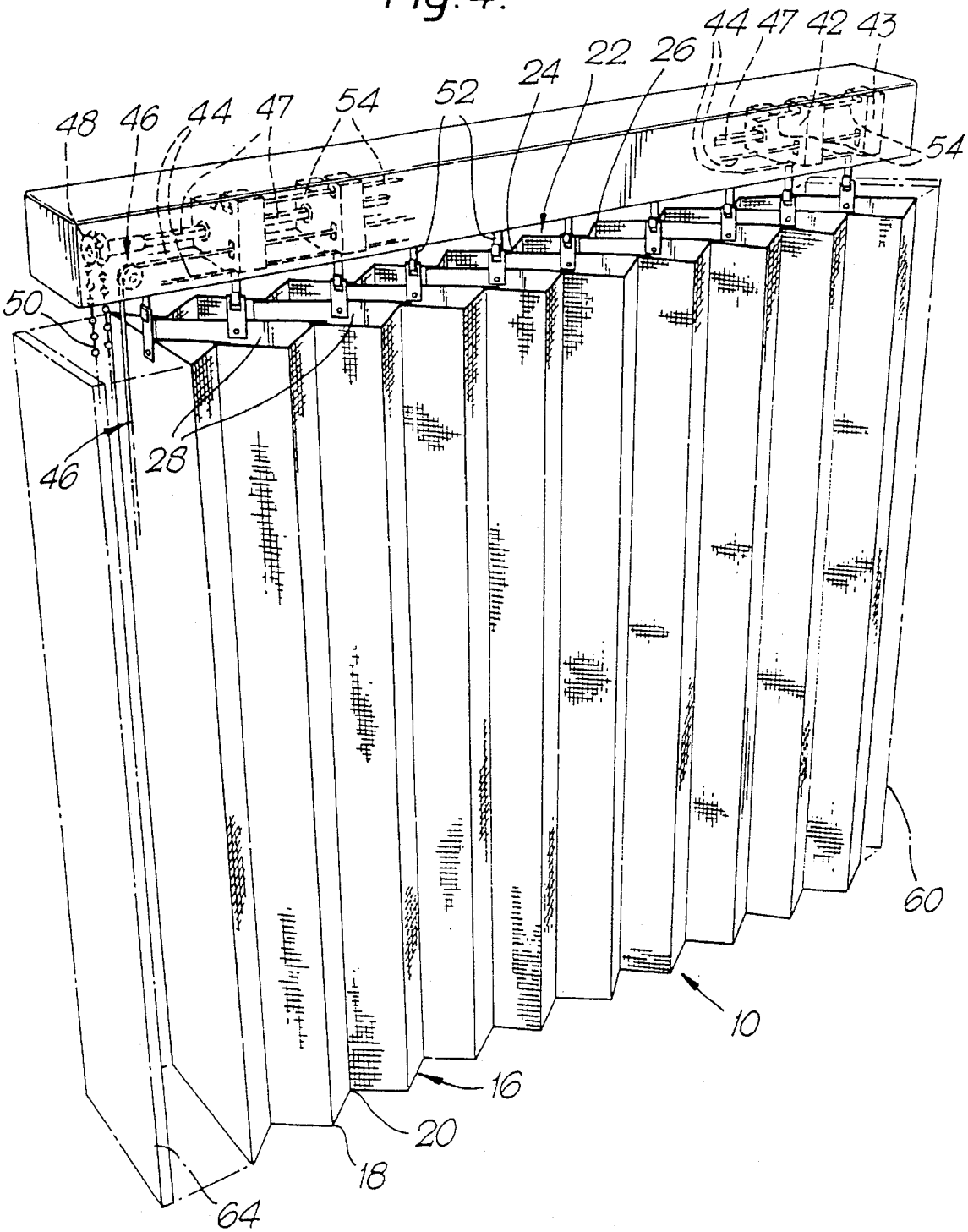
FIG. 4 is a schematic perspective view of a second embodiment of blind assembly according to the invention.

If reference is now made to FIG. 4, a further rather different structure is illustrated. This structure has the pleats of the sheer fabrics extending generally vertically. In detail, therefore, the structure of FIG. 4 employs a headrail 40 in which are mounted a plurality of sliding carriers 42 which are preferably provided with wheels (not shown) for running along guide tracks 44 formed in the headrail. Movement of the carriers 42 can be effective in any suitable manner but as shown a cord system 46 is provided. The assembly of carriers in the headrail may be generally similar to that disclosed in U.S. Pat. No. 3,996,988 in the name Dwight or in U.S. Pat. No. 4,267,875, in the name Koks. As in the Koks patent, a tilt rod 47 is provided and this may be rotated by a pulley 48 with a bead chain 50. The tilt rod 47 is associated with a worm and worm wheel, as in Koks U.S. Pat. No. 4,267,875, and the worm wheel in each carrier is connected to a separate hanger 52.

Now the blind material shown in FIG. 4 is generally similar to the blind material shown in FIG. 2 and like parts have been shown by like reference numerals. In this structure, however, the pleats 18,20,24,26 extend vertically as do the vanes 28. The upper ends of the vanes are mounted on the hangers 52. It would be appreciated that the operation of the vanes can be effected by operation of the bead chain 50 rotating the pulley 48 which in turn rotates the tilt rod 47. Rotation of this tilt rod will effect rotation of the worm wheel and pinion (not shown) which will in turn cause the hangers 52 to rotate about their respective vertical axes. This rotation will, it will be appreciated, cause tilting of the vanes 28 about their respective vertical axes.

If one operates the pull cord 46 then the end one 43 of the carriers will be pulled to the left or the right. Since these carriers have associated with them spacers 54, movement to the right of the end carrier 43 will cause the adjacent carrier 42 to move to the right with it and then the subsequent carriers will also in turn move to the right to provide the right spacing.

As shown in this structure, a first end rail 60 is associated with the right hand end of the sheer fabrics, rather in the manner of the bottom rail 30 of FIGS. 2 and 3. This end rail can be mounted on its own hanger which would then be associated with the end carrier 43, or it can be mounted on the same carrier as the right hand most vane. This end rail will then move with the end carrier and will act as a positive end to the "curtain" formed by the blind assembly of the invention. A second end rail 64 may, if desired, be provided at the other end. However, neither of the end rails are absolutely essential with the structure.

Figure 5:
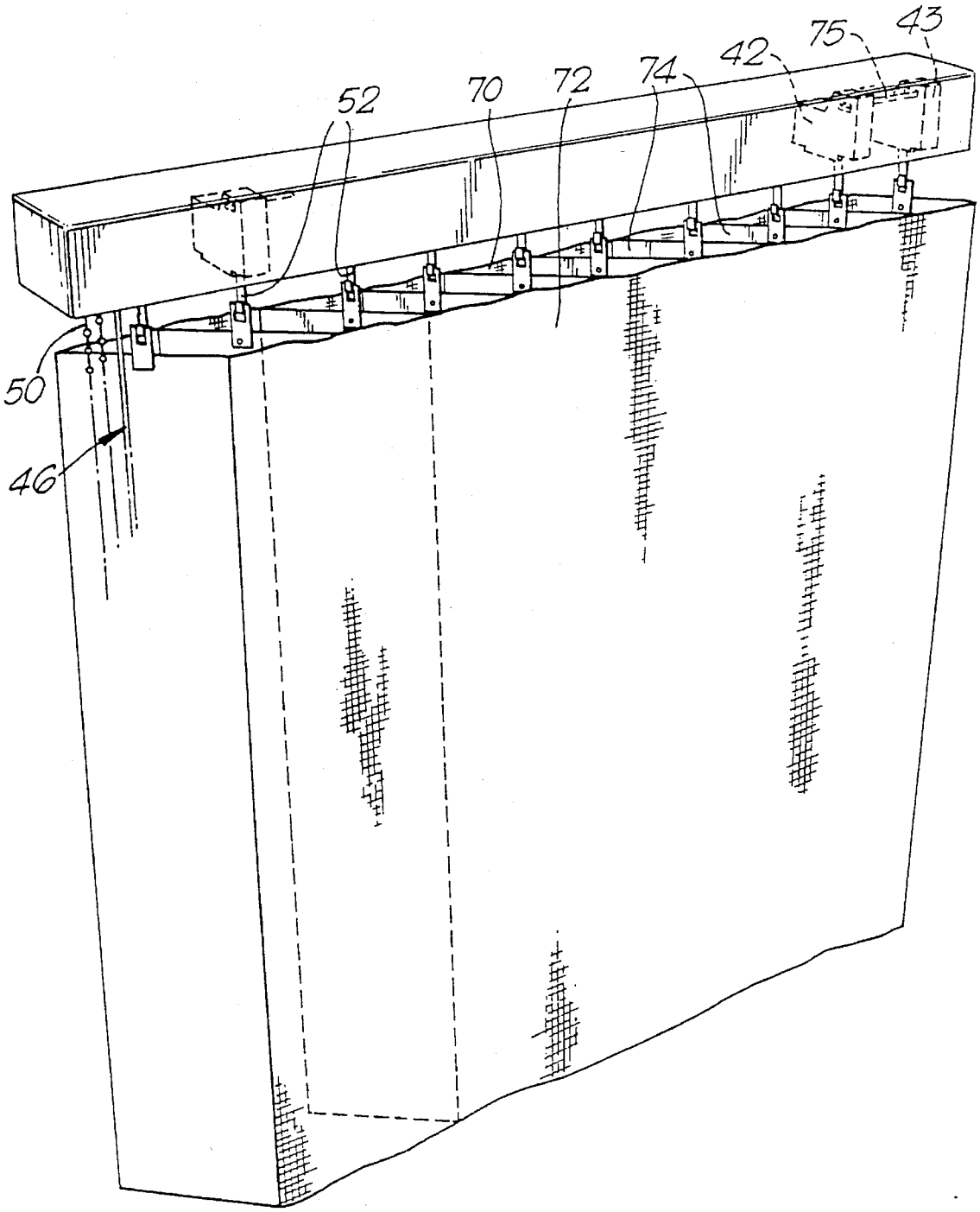
FIG. 5 is a view similar to FIG. 4 of a further embodiment.

If reference is now made to FIG. 5, a modified version of this structure is illustrated. Here, instead of having a pleated front and rear sheer fabrics, the sheer fabrics illustrated are generally planar front and rear sheer fabrics 70,72 between which extend vanes 74, which may be connected to the fabrics 70,72 in the same way as described above with reference to FIG. 4. The mounting of the vanes 74 is identical to the mounting of the vanes 28 of the FIG. 4 construction. Again, end rails (not shown in this figure) may be provided if so desired.

It will be appreciated that when the end carrier 43 is moved to the right, this will have the effect of moving the vane associated therewith. After a certain distance of movement, the sheer fabrics themselves will cause the next vane, and its carrier, to move to the right also and so on. However, in order to protect the sheer fabrics, it is preferred that spacers similar to the spacers 54 of FIG. 4 be provided for this purpose and these are indicated schematically at 75.

In the structure of FIG. 4 or FIG. 5, the window covering may be simply opened by manually moving the end rail 60.

I claim:

1. A window blind comprising in combination, a front light transmitting sheet having a plurality of parallel alternately forwardly and rearwardly directed pleats formed therein, a rear light transmitting sheet spaced apart from said front sheet in substantially parallel relation therewith and having a plurality of parallel alternately forwardly and rearwardly directed pleats formed therein, each forwardly directly pleat on one of said sheets in a neutral position of said window blind being in alignment with a rearwardly directed pleat on the other of said sheets, and a plurality of substantially parallel relatively non-light transmitting vanes having opposite side edges, one side edge of each vane being attached to said front sheet and the other side edge being attached to said rear sheet, whereby when one of said sheets is moved with respect to the other of said sheets from said neutral position in one direction of movement transverse to said vanes, said vanes are caused to lie perpendicular to said sheets whereby to allow passage of light through the blind material, and when said sheets are moved relative to each other from said neutral position in the opposite direction of movement said vanes are caused to at least partially block the passage of light through the blind material, and wherein said one side edge of each vane is attached to said front sheet adjacent to a forwardly extending pleat thereof and said other side edge of each vane is attached to said rear sheet adjacent to a forwardly extending pleat thereof.

2. The window blind of claim 1 wherein said one side edge and said other side edge of said vanes being attached to the front sheet and the rear sheet such that said edges extend parallel to each other in said neutral position of the window blind and the vane between said edges extends in a generally S shaped curve.

3. The window blind of claim 1 wherein said vanes extend vertically and further including a horizontal guide track; and a plurality of sliding carriers connected to the upper end of at least some of said vanes and slidable in said track.

4. The window blind of claim 3 and further comprising:

a) a further sliding carrier mounted on said horizontal guide track for movement therealong;

b) a first elongate end rail connected to said further sliding carrier, said first end rail hanging vertically from said further sliding carrier and moveable with said further sliding carrier as said further sliding carrier moves along said track, said first end rail being connected to one of said front and rear sheets; and c) a second elongate end rail connected to the other of said front and rear sheets at the end of said window covering opposite said first end rail.

5. The window blind of claim 3, wherein the one edge of each vane is connected to the rear, interior, face of a forwardly extending pleat of the front sheet and the other edge of each vane is connected to the front interior face of a forwardly extending pleat of the rear sheet.

6. The window blind of claim 3, wherein the one edge of each vane is connected to the rear, interior, face of a rearwardly extending pleat of the front sheet and the other edge of each vane is connected to the forward interior face of a forwardly extending pleat of the rear sheet.

7. The window blind of claim 3, further comprising means moving an end one of said carriers along said horizontal guide track, whereby movement in one direction will cause said one end carrier to abut and move the next adjacent carrier in said one direction and subsequent carriers will also be moved, effective to open said window covering, and movement in the opposite direction will cause said one carrier to pull the next adjacent carrier and subsequent carriers will be pulled effective to close said window covering.

8. The window blind of claim 7, further comprising spacer means connecting adjacent carriers at a predetermined spacing.

9. The window blind of claim 1, further including a hanger associated with each of said sliding carriers, said hangers being connected to the upper end of at least some of the vanes; and means to simultaneously rotate said hangers and thereby all of said vanes whereby when said hangers are rotated in one sense, the vanes are caused to lie parallel, thereby to allow passage of light through the blind and when said hangers are tilted in the opposite sense, adjacent vanes are caused to overlap, and thereby block the passage of light through the blind.

10. The window blind of claim 9 and further comprising:

a) a further sliding carrier mounted on said horizontal guide track for movement therealong;

b) a first elongate end rail connected to said further sliding carrier, said first end rail hanging vertically from said further sliding carrier and moveable with said further sliding carrier as said further sliding carrier moves along said track, said first end rail being connected to one of said front and rear sheets; and c) a second elongate end rail connected to the other of said front and rear sheets at the end of said window covering opposite said first end rail.

11. The window blind of claim 9, further comprising means moving an end one of said carriers along said horizontal guide track, whereby movement in one direction will cause said one end carrier to abut and move the next adjacent carrier in said one direction and subsequent carriers will also be moved, effective to open said window covering, and movement in the opposite direction will cause said one carrier to pull the next adjacent carrier and subsequent carriers will be pulled effective to close said window covering.

12. The window blind of claim 11, further comprising spacer means connecting adjacent carriers at a predetermined spacing.

13. The window blind of claim 9, wherein said front and rear sheets each comprise a plurality of transverse, parallel alternate forward and rearward pleats.

14. The window blind of claim 13, wherein the one edge of each vane is connected to the rear, interior, face of a forwardly extending pleat of the front sheet and the other edge of each vane is connected to the front interior face of a forwardly extending pleat of the rear sheet.

15. The window blind of claim 13, wherein the one edge of each vane is connected to the rear, interior, face of a rearwardly extending pleat of the front sheet and the other edge of each vane is connected to the forward interior face of a forwardly extending pleat of the rear sheet.

16. A window blind comprising in combination, a front light transmitting sheet having a plurality of parallel alternately forwardly and rearwardly directed pleats formed therein, a rear light transmitting sheet spaced apart from said front sheet in substantially parallel relation therewith and having a plurality of parallel alternately forwardly and rearwardly directed pleats formed therein, each forwardly directly pleat on one of said sheets in a neutral position of said window blind being in alignment with a rearwardly directed pleat on the other of said sheets, and a plurality of substantially parallel relatively non-light transmitting vanes having opposite side edges, one side edge of each vane being attached to said front sheet and the other side edge being attached to said rear sheet, whereby when one of said sheets is moved with respect to the other of said sheets from said neutral position in one direction of movement transverse to said vanes, said vanes are caused to lie perpendicular to said sheets whereby to allow passage of light through the blind material, and when said sheets are moved relative to each other from said neutral position in the opposite direction of movement said vanes are caused to at least partially block the passage of light through the blind material, and wherein said one side edge of each vane is attached to said front sheet adjacent to a rearwardly extending pleat thereof and said other side edge of each vane is attached to said rear sheet adjacent to a forwardly extending pleat thereof.

17. A window blind as defined in claim 16 wherein said vanes in the neutral position of the window blind form substantially straight planar extensions from said pleats of the front and rear sheets.

18. The window blind of claim 16 wherein said vanes in the neutral position of the window blind extend the full width of one pleat in the front or rear sheets and wherein one side edge of a vane in the neutral position is aligned with the other side edge of the next adjacent vane.

* * * * *

UNITED STATES PATENT AND TRADEMARK OFFICE

CERTIFICATE OF CORRECTION

PATENT NO. : 5,454,414

DATED : Oct. 3, 1995

INVENTOR(S) : Wendell B. Colson, et al.

It is certified that error appears in the above-indentified patent and that said Letters Patent is hereby corrected as shown below:

| | |
|---|---|
| Cover page [75] Inventors | Add "Brian Hoffmann, Westminster, Colorado" |

Signed and Sealed this

Twenty-fifth Day of February, 1997

*Attest:*

Bruce Lehman

BRUCE LEHMAN

*Attesting Officer*

*Commissioner of Patents and Trademarks*